US008491285B2

(12) United States Patent
Haser et al.

(10) Patent No.: US 8,491,285 B2
(45) Date of Patent: Jul. 23, 2013

(54) TUBING CASSETTE FOR A PERISTALTIC PUMP

(75) Inventors: Christian Haser, Berlin (DE); Peter Zentner, Berlin (DE)

(73) Assignee: W.O.M. World of Medicine AG, Berlin (DE)

( * ) Notice: Subject to any disclaimer, the term of this patent is extended or adjusted under 35 U.S.C. 154(b) by 925 days.

(21) Appl. No.: 11/709,348

(22) Filed: Feb. 22, 2007

(65) Prior Publication Data

US 2007/0217933 A1 Sep. 20, 2007

(30) Foreign Application Priority Data

Feb. 20, 2006 (DE) ..... 10 2006 008 325

(51) Int. Cl.
*F04B 43/08* (2006.01)
*F04B 43/12* (2006.01)
*F04B 45/06* (2006.01)

(52) U.S. Cl.
USPC ..... 417/477.2

(58) Field of Classification Search
USPC ..... 417/477.9, 477.1–477.13, 477.2, 417/477.3, 477.4, 477.5, 477.6, 477.7, 477.8, 417/477.11, 477.12; 604/153
See application file for complete search history.

(56) References Cited

U.S. PATENT DOCUMENTS

| | | | | |
|---|---|---|---|---|
| 3,927,955 | A * | 12/1975 | Spinosa et al. | 417/477.3 |
| 4,187,057 | A | 2/1980 | Xanthopoulos | 417/63 |
| 4,537,561 | A | 8/1985 | Xanthopoulos | 417/63 |
| 4,735,558 | A * | 4/1988 | Kienholz et al. | 417/477.2 |
| 4,798,580 | A | 1/1989 | DeMeo et al. | 604/30 |
| 5,044,902 | A | 9/1991 | Malbec | 417/477 |
| 5,064,358 | A | 11/1991 | Calari | 41/475 |
| 5,195,960 | A * | 3/1993 | Hossain et al. | 604/34 |
| 5,213,483 | A | 5/1993 | Flaherty et al. | 417/477 |
| 5,215,450 | A * | 6/1993 | Tamari | 417/474 |
| 5,324,180 | A * | 6/1994 | Zanger | 417/475 |
| 5,433,588 | A * | 7/1995 | Monk et al. | 417/477.2 |
| 5,588,815 | A * | 12/1996 | Zaleski, II | 417/477.2 |
| 5,620,312 | A * | 4/1997 | Hyman et al. | 417/474 |
| 5,928,196 | A * | 7/1999 | Johnson et al. | 604/153 |
| 6,203,296 | B1 * | 3/2001 | Ray et al. | 417/477.7 |
| 6,468,059 | B2 * | 10/2002 | Haser et al. | 417/477.1 |
| 6,835,049 | B2 * | 12/2004 | Ray | 417/63 |
| 7,445,436 | B2 * | 11/2008 | Mittelstein et al. | 417/477.3 |
| 2004/0037724 | A1 | 2/2004 | Haser et al. | 417/477.9 |

FOREIGN PATENT DOCUMENTS

DE 236 143 A1 5/1986

(Continued)

*Primary Examiner* — Devon Kramer
*Assistant Examiner* — Amene Bayou
(74) *Attorney, Agent, or Firm* — Karin L. Williams; Mayer & Williams

(57) ABSTRACT

The invention concerns a hose cartridge for a peristaltic pump comprising a cartridge housing, comprising a flexible pump hose segment extending through the cartridge housing, wherein both ends of the pump hose segment are fixed in the cartridge housing by a first fixing member and a second fixing member, wherein the first fixing member and the second fixing member are arranged in the area of a first front face of the cartridge housing, and wherein the cartridge housing includes a recess for the engagement of a roller wheel of the pump in the interior of the cartridge housing. It is characterized by that the pump hose segment extends in the hose cartridge along a circular segment (K) spanning an angle of at least 90°, when the hose cartridge is not inserted into the pump.

16 Claims, 4 Drawing Sheets

FOREIGN PATENT DOCUMENTS

| | | |
|---|---|---|
| DE | G 89 07 184.0 | 9/1989 |
| DE | 199 60 668 C1 | 8/2001 |
| DE | 100 62 600.9 | 6/2002 |
| EP | 0 346 784 B1 | 12/1989 |

* cited by examiner

TUBING CASSETTE FOR A PERISTALTIC PUMP

FIELD OF THE INVENTION

The invention is directed to a hose cartridge for a peristaltic pump including a cartridge housing, a flexible pump hose segment extending through the cartridge housing, wherein both ends of the pump hose segment are fixed in the cartridge housing by means of a first fixing member and of a second fixing member, wherein the first fixing member and the second fixing member are arranged in the area of a first front face of the cartridge housing, and wherein the cartridge housing includes a recess for the engagement of a roller wheel of the pump in the interior of the cartridge housing. The invention is further directed to a peristaltic hose pump system including such a hose cartridge.

BACKGROUND OF THE INVENTION

Peristaltic hose pumps are, for instance, used as suction and rinse pumps for medical purposes, in particular in minimal-invasive surgery. Specific applications include arthroscopy, laparoscopy, urology, hysteroscopy and cystoscopy. For medical applications, in particular a sterility meeting all requirements is needed, and for this reason, after use, the hose cartridge is usually disposed of, in order to avoid cross contamination between different patients. Therefore, the hose cartridges have to be low-priced, and, in particular, permit simple handling by operators, when the hose cartridge is connected with the pump as well as when it is removed therefrom.

For prior art peristaltic pumps, there are in principle two different basic concepts. The first basic concept is that the hose arranged around the roller wheel is pressed by means of a pressure bracket or the like against the roller wheel. Such peristaltic hose pumps systems are for instance known from the documents U.S. Pat. No. 4,798,580, U.S. Pat. No. 5,044,902, U.S. Pat. No. 5,213,483 and DE 100 62 600.9 A1. By a closure lever mechanism, the hose is fixed and pressed against the roller wheel by means of a pressure bracket.

The second basic concept, which the invention in principle uses, is that the hose is drawn around the roller wheel with a sufficient encircling angle by a traction of a suitable size. Thereby, a pressure bracket or the like is not required. The traction has to be selected, in consideration of the elastic properties of the hose, such that in the area of a roller of a roller wheel, the inner cross section of the hose is practically reduced to zero. With regard thereto, it is for instance known from the document DE 199 60 668 C1 that in a hose cartridges at least one leg of the pump hose segment following the circular segment is arranged displaceably in the longitudinal direction of the hose in the cartridge housing between a mounting position and an operating position. This is in principle very well established, yet requires a relatively complicated construction and is thus expensive to manufacture.

A hose cartridge of the construction mentioned above is known from the document U.S. Pat. No. 4,537,561. Therein, a straight pump hose segment is provided in a hose cartridge. The hose cartridge is inserted at right angles to the extension of the pump hose segment into the peristaltic pump, and the pump hose segment comes into contact with the roller wheel and is tensioned, during the insertion of the hose cartridge, with a low encircling angle around the roller wheel. In the insofar known hose cartridges, it is a disadvantage that, due to the geometry of the components, a sufficient pressure on the pump hose segment by the roller wheel is only achieved with relatively high forces. On the one hand, this requires high forces for the insertion of the hose cartridge, while on the other hand, components of the hose cartridge are subjected to bending moments, thus requiring a relatively stable structure.

TECHNICAL OBJECT OF THE INVENTION

It is therefore an object of the invention to provide a hose cartridge and a peristaltic hose pump system, wherein the hose cartridge can be mounted easily and safely, has a simple structure and a high reliability.

SUMMARY OF THE INVENTION AND PREFERRED EMBODIMENTS

For achieving this technical object, the invention teaches that the pump hose segment extends in the hose cartridge along a circular segment spanning an angle of at least 90°, when the hose cartridge is not inserted into the pump. Preferably, the circular segment spans an angle from at least 120° to at least 160°, ideally approx. 180°. In other words, the ends of the pump hose segment are arranged at an angle with respect to each other from 90° to 220°, preferably from 150° to 200°, ideally from 170° to 190°, for instance approx. 180°. An angle of 0° means the angle of the ends with respect to each other, which the ends enclose for a straight extension of the pump hose segment with respect to each other.

Thereby it is achieved that the ends of the pump hose segment are practically exclusively subjected to tension. Further, by the high encircling angle, a safe sealing of the hose by the roller wheel is secured, and consequently a high achievable peristaltic pressure is obtained. In any case, it is not required to provide pressure means for pressing the pump hose segment against the roller wheel, when the hose cartridge is inserted into the pump. Equally, displaceable ends of the pump hose segment for the purpose of tensioning the pump hose segment around the roller wheel are not needed. Rather, the ends of the pump hose segment are stationary relative to the cartridge housing.

For the purpose of invention, in principle two different variants are possible.

On the one hand, it may be provided that the recess for the roller wheel extends in the area of the first front face between the first fixing member and the second fixing member. Then the insertion of the hose cartridge is achieved by a substantially linear movement from a mounting position into an operating position in a direction radially with regard to the roller wheel.

On the other hand, the recess may extend in an area of a side surface of the cartridge housing being orthogonal to the first front face and parallel to the circular segment. Then the cartridge can be inserted in a mounting position by placing the cartridge on the roller wheel in an axial direction. Thereafter follows either a linear displacement of the cartridge in a radial direction of the roller wheel or a rotational movement of the cartridge with a movement component radially to the roller wheel. Both movements terminate in the operating position. In each of the above variants, the pump hose segment is tensioned around the roller wheel by the movement of the hose cartridge into the operating position.

A preferred embodiment of the invention is characterized by that the fixing members comprise two hose lines each hydrostatically communicating with one end of the pump hose segment, the hose lines preferably being arranged substantially antiparallely to the ends of the pump hose segment. Then the hose lines can exit in particular through a second front face of the cartridge housing being opposed to the first front face. The term antiparallel relates to the flow direction of a fluid in the ends of the pump hose segment or in the hose lines. This embodiment is in particular suitable for a variant of the invention, in which the hose cartridge is displaced by a linear movement in the direction radially to the roller wheel into the operating position. In this embodiment it is further easily achievable that the roller wheel is arranged in the interior of a pump housing, thus any risk of injury or access possibility in the area of the roller wheel being excluded. Guiding of the linear movement of the hose cartridge is then performed by a cartridge pit being complementary to the shape of the hose cartridge.

In a cartridge housing according to the invention, there may also be provided two (or more) substantially parallel, stacked pump hose segments. In a corresponding manner, the hose lines connected to the ends of the pump hose segments have also to be doubled. In this embodiment, typically two roller wheels are provided in the pump, one pump hose segment each being assigned to one roller wheel. In this embodiment, it may also provided that both roller wheels can be controlled separately. In this way, for instance an independent control of a sucking function may take place by means of one pump hose segment, and a rinsing function by means of the other pump hose segment. It is however also possible to use one roller wheel only, and the roller wheel has then the necessary width in order to tension both pump hose segments simultaneously around the roller wheel.

Furthermore, it may be provided that at least one fixing member comprises a flexible membrane arranged in the area of the first front face and hydrostatically communicating with the pump hose segment. In the operating position of the hose cartridge, this flexible membrane is then in connection with a force and/or travel transducer, thereby in the operating position of the hose cartridge at last a pressure measurement being possible. Usually it will be recommended to arrange this flexible membrane at each fixing member, which represents the pressure side of the pump hose segment.

The invention further relates to a peristaltic hose pump system comprising at least one hose cartridge according to the invention, comprising a pump, which has at least one pump housing and a driven roller wheel, the hose cartridge and the pump housing having connecting members being complementary to each other, which are arranged relative to each other such that the pump hose segment is tensioned around the roller wheel, when the hose cartridge is connected with the pump housing and moved into an operating position.

As connecting members may in particular be used detachable latch connections. In detail, the connecting members may comprise the following components: a) at least one guide element arranged at or in the pump housing for a translational movement of the hose cartridge in directions orthogonally to the first front face (and radially to the roller wheel), b) at least one latch connection with a first latch element arranged at the cartridge housing and a second latch element arranged at the pump housing and being complementary to the first latch element, the latch connection latching thereinto, when the hose cartridge is displaced in the direction of the operating position, and c) a detachment member for releasing the latch connection. Alternatively, the connecting members may comprise the following components: a) at least one pivot axis arranged at or in the pump housing and substantially extending parallely to the axis of rotation of the roller wheel, about said pivot axis the hose cartridge being swiveling, the pivot axis being laterally displaced compared to the center of the pump hose segment, referred to the first front face, b) a latch connection with a first latch element arranged at the cartridge housing and a second latch element arranged at the pump housing and being complementary to the first latch element, the latch connection latching thereinto, when the hose cartridge is rotated about the pivot axis into the operating position, and c) a detachment member for releasing the latch connection. In either case, the hose cartridge is displaced or swiveled in a simple way and by using one hand only in the direction of the operating position, until the latch connection is activated. By actuation of the detachment member, then not only the latch connection is detached, but by the tension of the pump hose segment provided in the operating position, there is also an automatic ejection of the hose cartridge, in particular in the case of the variant with translational movements between the mounting and operating positions.

For a hose cartridge having a flexible membrane, it may be provided that the pump housing comprises a force and/or travel transducer being connected in the operating position of the hose cartridge with the flexible membrane of the hose cartridge. Thereby the pressure force of the fluid provided by the flexible membrane is converted in the fixing member into an electrical signal, which can then be used for pressure display and/or control or regulation purposes.

A peristaltic pump according to the invention typically comprises an electric motor drive means for the roller wheel. This may be a direct-current motor, an alternating-current motor or a stepper motor. Between a drive shaft of the motor and the drive shaft of the roller wheel, a mechanical reduction gear may be provided. However, a direct drive is also possible, for instance in the case of the stepper motor. Typically, the rotational speed of the motor is controllable and adjustable. For this purpose, typically a control circuitry is provided, and an operator can adjust the desired flow rates or pressures by control elements, such as buttons or switches, and the control circuitry controls and adjusts the correlated speeds according to an operating program. Further, the control circuitry will compare if applicable pressure values measured in the pump hose segment to desired pressure values or maximum pressure values and control the speed of the roller wheel in a corresponding manner. In an extreme case, the roller wheel may also be controlled in a reverse direction of rotation. A peristaltic pump according to the invention may alternatively or optionally be operated with mains voltage or with a battery or an accumulator. The technologies for drive and control or adjustment of a roller wheel of a peristaltic hose pump are known in the art and therefore need not to be explained here in more detail.

The hose cartridge or the cartridge housing may comprise a coding, which is specific for an application, such as arthroscopy, laparoscopy, urology or hysteroscopy. In the operating position of the hose cartridge, then by suitable means of the pump this code can be read. These means are in connection with the electronic controller and control for the respective application suitable operating parameters according to the operating program. Coding may take place mechanically, by means of a transponder or smart labels or the like.

BRIEF DESCRIPTION OF THE DRAWINGS

In the following, the invention will be explained in more detail with reference to figures representing examples of execution only.

In FIG. 1 can be seen in an external view a pump 2, which comprises a pump housing 16 and at least one driven roller wheel 11. The roller wheel 11 is arranged in a cartridge pit 20 in the interior of the pump housing 16. In the cartridge pit 20 can further be seen a detachable latch hook 18 and a force or travel transducer 19.

In FIG. 3 can be seen the essential mechanical components of the pump 2. The roller wheel 11 is driven by a motor/gear unit 21. In the motor/gear unit 21 is provided an electrically controllable stepper motor, which is connected to the drive shaft of the roller wheel 11. At the end of the cartridge pit 20 opposite to the opening, the force or travel transducer 19 is disposed. Further can be seen a valve member to be actuated in an axial direction, which represents in combination with a hose line a so-called pinch valve, when the cartridge is inserted. When activated, the actuation member 22 presses the hose line flat, such that it will not let pass the fluid.

In FIG. 2 can be seen a hose cartridge 1 according to the invention, which can be inserted into the cartridge pit 20 of FIG. 1. One can see first a cartridge housing 3, in which a flexible pump hose segment 4 is arranged. The two ends 5, 6 of the pump hose segment 4 are fixed in the cartridge housing 3 by means of a first fixing member 7 and of a second fixing member 8. The first fixing member 7 and the second fixing member 8 are arranged in the area of the first front face 9 of the cartridge housing 3.

Figure 1:
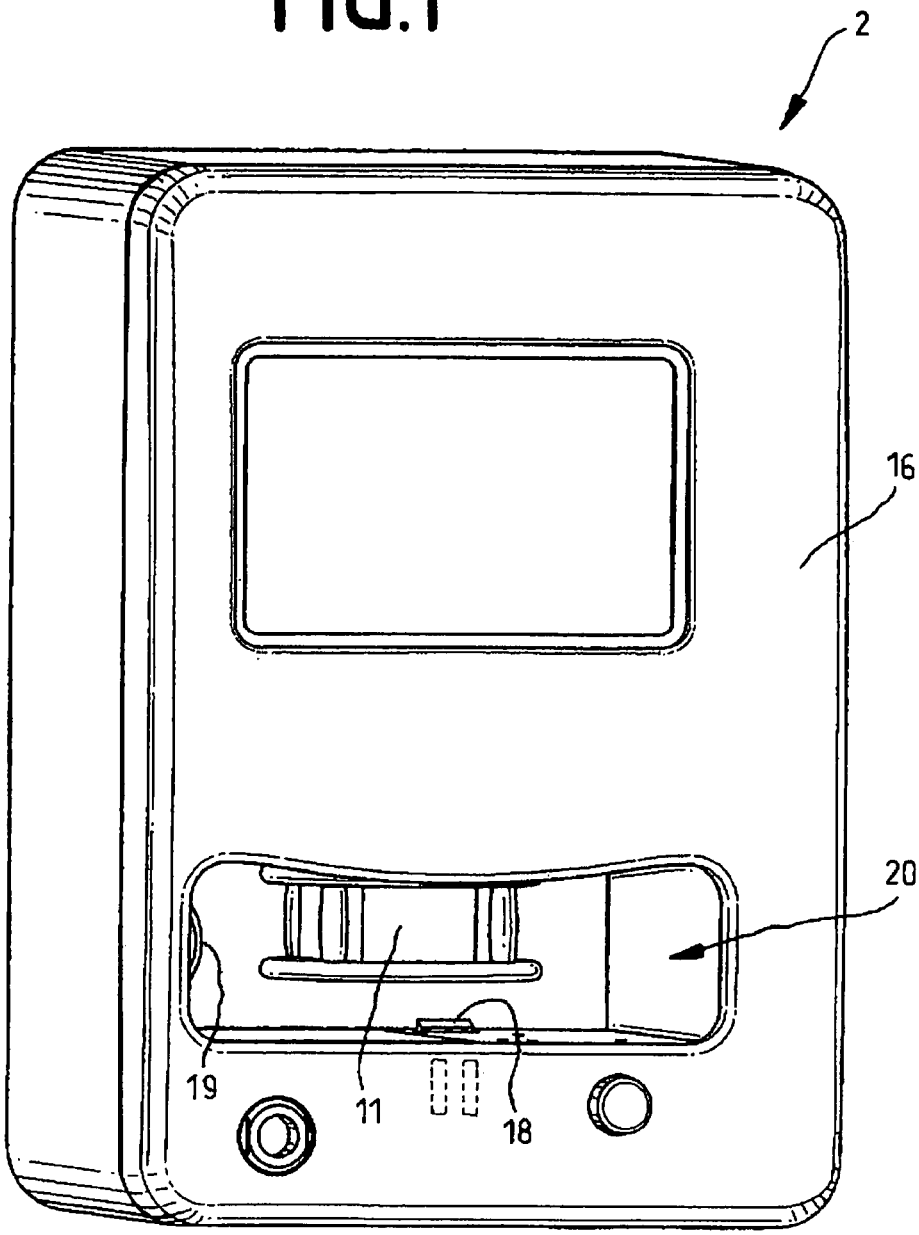
FIG. 1 is an external view of a peristaltic pump according to the invention.

The cartridge housing 3 comprises a recess 10 for the engagement of the roller wheel 11 of the pump 2 in the interior of the cartridge housing 3. The recess 10 is arranged substantially in the area of the first front face 9 between the first fixing member 7 and the second fixing member 8. It also extends, however, in part into the side surface 12 of the cartridge housing 3 arranged at right angles to the first front face 9, such that the cartridge housing 3 can completely be slid over the roller wheel 11. The pump hose segment 4 is arranged in the hose cartridge 1 along a circular segment K spanning an angle of approx. 180°, when the hose cartridge 1 is not inserted into the pump 2. It is understood that that the term circular segment K needs not necessarily extend precisely along a circular arc, but represents the course, which results at a given angle of the two ends 5, 6 with respect to each other (here 180°).

Figure 2:
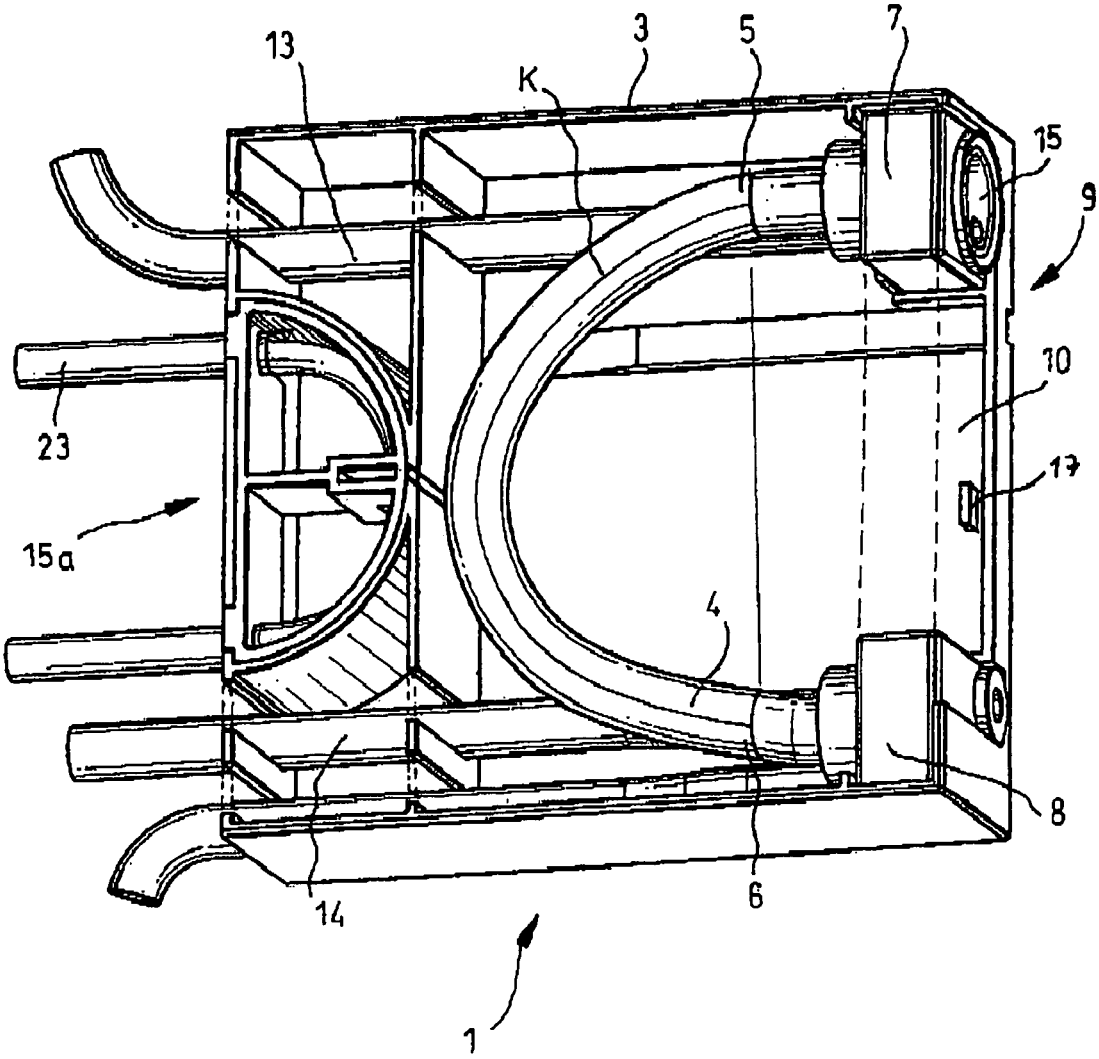
FIG. 2 illustrates a view of a hose cartridge according to the invention with detached side wall.

From FIG. 2 can further be taken that the fixing members 7, 8 comprise two hose lines 13, 14 each hydrostatically communicating with one end 5, 6 of the pump hose segment 4 or being connected thereto, and in this embodiment the hose lines 13, 14 are arranged substantially antiparallely to the ends 5, 6 of the pump hose segment 4. The hose lines 13, 14 exit the cartridge housing 3 through the second front face 15*a* of the cartridge housing 3 being opposite to the first front face 9. At a fixing member 7 a flexible membrane 15 is provided, which is arranged in the area of the first front face 9 and hydrostatically communicates with the pump hose segment 4 or is connected thereto. The membrane interacts with the force/travel transducer 19, when the cartridge is inserted in the operating position, and then represents a pressure measuring device. In FIG. 2 can finally be seen a drain hose 23.

Figure 3:
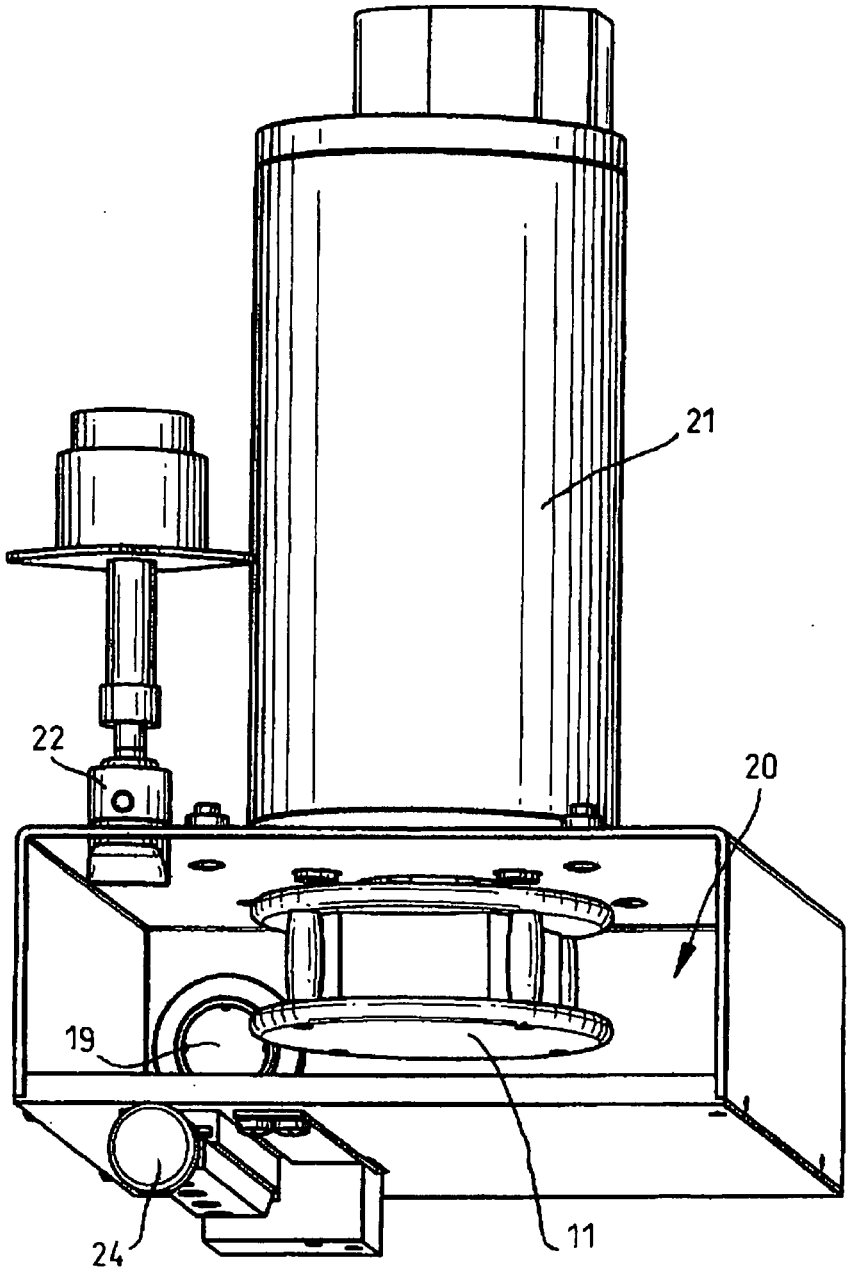
FIG. 3 illustrates the essential mechanical components of the subject matter of FIG. 1.

From a comparative inspection of FIGS. 1 to 3 can be found that the cartridge pit 20 represents a guide element for a translational movement of the hose cartridge 1 in directions orthogonally to the first front face 9. At the cartridge housing 3, a latch recess 17 is provided, which interacts in a latching manner with the latch hook 18 of the pump 2 in the operating position of the hose cartridge 1. Finally, a button 24 can be seen, which acts as a detachment member for releasing the latch connections. When the button 24 is actuated, the latch hook 18 is pulled in an axial direction of the roller wheel 11 and thus releases the latch recess 17 of the cartridge housing 3. Because of the tension of the pump hose segment 4 in the operating position, then the hose cartridge 1 is automatically ejected from the pump housing 16.

Figure 4:
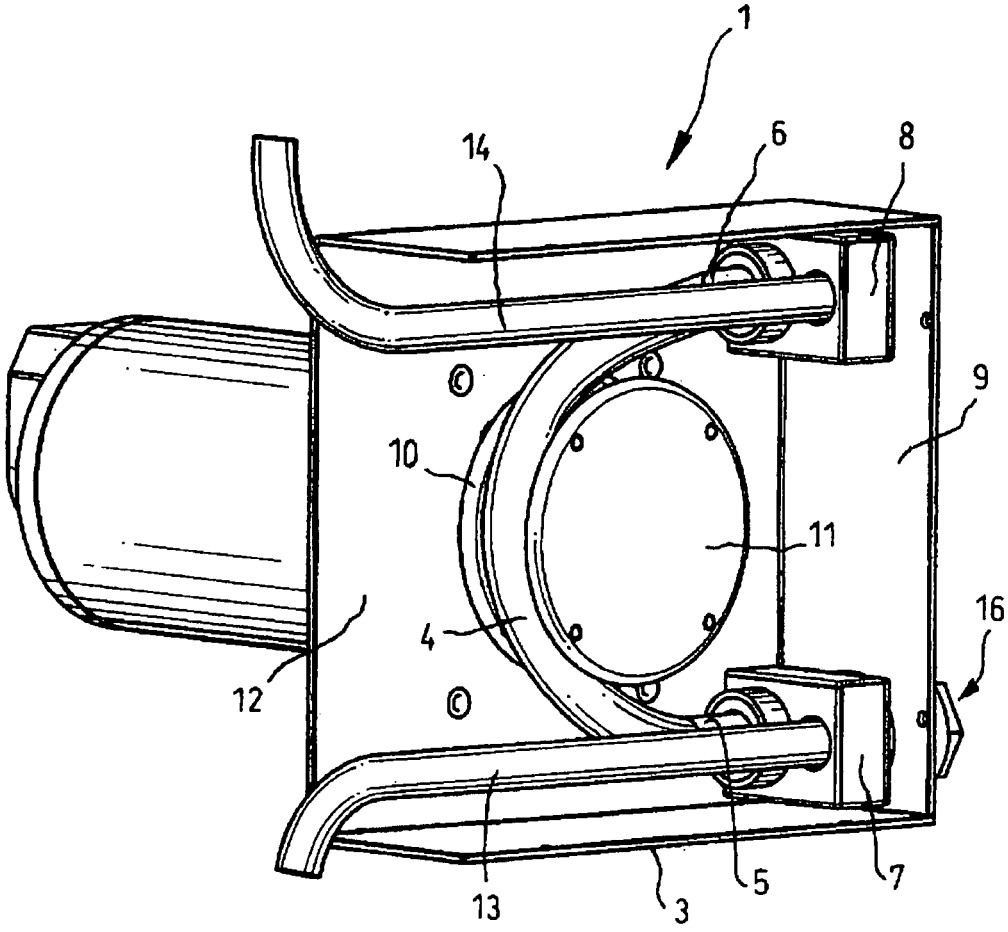
FIG. 4 shows a variant of a peristaltic hose pump system according to another embodiment of the invention.

In FIG. 4 can be seen a variant of the system according to the invention. Herein, the hose cartridge 1 is first mounted in an axial direction of the roller wheel 11, and the roller wheel 11 passes through the recess 10 of the side surface 12. Thereafter, the hose cartridge 1 is brought from the mounting position into the operating position, either by displacement of the hose cartridge 1 in a direction radially to the roller wheel 11 or by pivoting of the hose cartridge 1 about a pivot axis, which is located outside of the roller wheel 11. In principle, all above details apply in an analogous manner. This variant of the invention is usually used, when in lieu of a roller wheel 11 arranged in a cartridge pit 20, a roller wheel 11 standing free and rotating outside of the pump housing 16 is to be provided.

The invention claimed is:

1. A hose cartridge for a peristaltic pump comprising: a cartridge housing including, a single flexible pump hose segment extending through the cartridge housing, wherein two ends of the single pump hose segment are fixed in the cartridge housing by means of a first fixing member and of a second fixing member, respectively, in a stationary manner, wherein the first fixing member and the second fixing member are arranged at a first front face of the cartridge housing, and wherein the two ends of the single pump hose segment are fixed to the first fixing member and the second fixing member at the first front face of the cartridge housing, wherein at least one of the first fixing member and the second fixing member includes a flexible membrane arranged in the area of the first front face and hydrostatically communicating with the single pump hose segment, wherein the cartridge housing includes a recess for the engagement of a roller wheel of the pump in the interior of the cartridge housing, and wherein the single pump hose segment extends in the hose cartridge along a circular segment (K) spanning an angle of at least 90°, when the hose cartridge is not inserted into the pump.

2. A hose cartridge according to claim 1, wherein the recess extends in an area of the first front face between the first fixing member and the second fixing member or the recess extends in an area of a side surface of the cartridge housing being orthogonal to the first front face and parallel to the circular segment (K).

3. A hose cartridge according to claim 2, wherein in the cartridge housing two or more substantially parallel stacked pump hose segments are provided.

4. A hose cartridge according to claim 1, wherein the circular segment (K) spans an angle of at least 120.

5. A hose cartridge according to claim 4, wherein in the cartridge housing two or more substantially parallel stacked pump hose segments are provided.

6. A hose cartridge according to claim 1, wherein the fixing members comprise two hose lines each hydrostatically communicating with the first end and the second end, respectively, of the pump hose segment, wherein the hose lines are arranged substantially non-parallel to the ends of the pump hose segment.

7. A hose cartridge according to claim 6, wherein the hose lines exit through a second front face of the cartridge housing being opposed to the first front face.

8. A hose cartridge according to claim 1, wherein in the cartridge housing, two or more substantially parallel stacked pump hose segments are provided.

9. A peristaltic hose pump system comprising:

a hose cartridge according to claim 1; and a pump, including a pump housing and at least one driven roller wheel, wherein the pump housing comprises a force and/or travel transducer being connected in the operating position of the hose cartridge with a flexible membrane of the hose cartridge, wherein the hose cartridge and the pump housing have connecting members being complementary with respect to each other, which are arranged relative to each other such that the single pump hose segment is tensioned around the roller wheel when the hose cartridge is connected with the pump housing and moved into an operating position.

10. A peristaltic hose pump system according to claim 9, wherein the connecting members comprise the following components:

a) at least one guide element arranged at or in the pump housing for a translational movement of the hose cartridge in directions orthogonally to the first front face, b) at least one latch connection comprising a first latch element arranged at the cartridge housing and a second latch element arranged at the pump housing and being complementary to the first latch element, the latch connection latching in, when the hose cartridge is displaced in a direction of the translational movement from a mounting position into an operating position, and c) a detachment member for releasing the latch connection.

11. A peristaltic hose pump system according to claim 9, wherein the connecting members comprise the following components:

a) at least one pivot axis arranged at or in the pump housing and substantially extending parallel to the axis of rotation of the roller wheel, about said pivot axis the hose cartridge swiveling, the pivot axis being laterally displaced compared to the center (Z) of the pump hose segment, referring to the first front face, b) a latch connection with a first latch element arranged at the cartridge housing and a second latch element arranged at the pump housing and being complementary to the first latch element, the latch connection latching in, when the hose cartridge is rotated about the pivot axis into the operating position, and c) a detachment member for releasing the latch connection.

12. A peristaltic hose pump system comprising:

a hose cartridge according to claim 2; and a pump, including a pump housing and at least one driven roller wheel, wherein the hose cartridge and the pump housing have connecting members being complementary with respect to each other, which are arranged relative to each other such that the single pump hose segment is tensioned around the roller wheel when the hose cartridge is connected with the pump housing and moved into an operating position.

13. A peristaltic hose pump system comprising: a hose cartridge according to claim 4; and a pump, including a pump housing and at least one driven roller wheel, wherein the hose cartridge and the pump housing have connecting members being complementary with respect to each other, which are arranged relative to each other such that the pump hose segment is tensioned around the roller wheel when the hose cartridge is connected with the pump housing and moved into an operating position.

14. A peristaltic hose pump system comprising:

a hose cartridge according to claim 6; and a pump, including a pump housing and at least one driven roller wheel, wherein the hose cartridge and the pump housing have connecting members being complementary with respect to each other, which are arranged relative to each other such that the single pump hose segment is tensioned around the roller wheel when the hose cartridge is connected with the pump housing and moved into an operating position.

15. A peristaltic hose pump system comprising:

a hose cartridge according to claim 7; and a pump, including a pump housing and at least one driven roller wheel, wherein the hose cartridge and the pump housing have connecting members being complementary with respect to each other, which are arranged relative to each other such that the single pump hose segment is tensioned around the roller wheel when the hose cartridge is connected with the pump housing and moved into an operating position.

16. A peristaltic hose pump system comprising:

a hose cartridge according to claim 8; and a pump, including a pump housing and at least one driven roller wheel, wherein the hose cartridge and the pump housing have connecting members being complementary with respect to each other, which are arranged relative to each other such that the single pump hose segment is tensioned around the roller wheel when the hose cartridge is connected with the pump housing and moved into an operating position.

* * * * *